United States Patent [19]

Maund

[11] Patent Number: 4,779,857

[45] Date of Patent: Oct. 25, 1988

[54] MULTI-PURPOSE WORK STATIONS

[75] Inventor: David J. Maund, North Humberside, England

[73] Assignee: J. & C. R. Wood, Hull, England

[21] Appl. No.: 14,177

[22] Filed: Feb. 12, 1987

Related U.S. Application Data

[63] Continuation of Ser. No. 801,391, Nov. 25, 1985, abandoned, which is a continuation of Ser. No. 560,470, Dec. 12, 1983, abandoned.

[30] Foreign Application Priority Data

Dec. 10, 1982 [GB] United Kingdom ..... 8235218

[51] Int. Cl.[4] ..... B25H 1/10

[52] U.S. Cl. ..... 269/71; 269/88; 269/203; 269/244; 269/261; 269/282; 144/1 C

[58] Field of Search ..... 269/71, 76–78, 269/88, 139, 203, 244, 261, 282, 283, 901; 144/1 C

[56] References Cited

U.S. PATENT DOCUMENTS

| | | | |
|---|---|---|---|
| 2,151,688 | 3/1939 | Carey | 144/1 C |
| 2,188,433 | 1/1940 | Friese | 269/78 |
| 2,964,075 | 12/1960 | Goldschmidt et al. | 144/1 C |
| 4,330,113 | 5/1982 | Ferdinand et al. | 269/88 |

*Primary Examiner*—Frederick R. Schmidt
*Assistant Examiner*—Judy J. Hartman
*Attorney, Agent, or Firm*—William A. Drucker

[57] ABSTRACT

A multiple purpose work station having an angularly displaceable spine of square section. The station also includes sockets for a headstock or other accessory which are secured to a nut so that rotation of a lead-screw by a handle axially displaces the headstock toward and away from a tailstock or other accessory. The latter is supported by a saddle which can be clamped in a desired position on the spine.

5 Claims, 3 Drawing Sheets

MULTI-PURPOSE WORK STATIONS

DESCRIPTION

Figure 1:
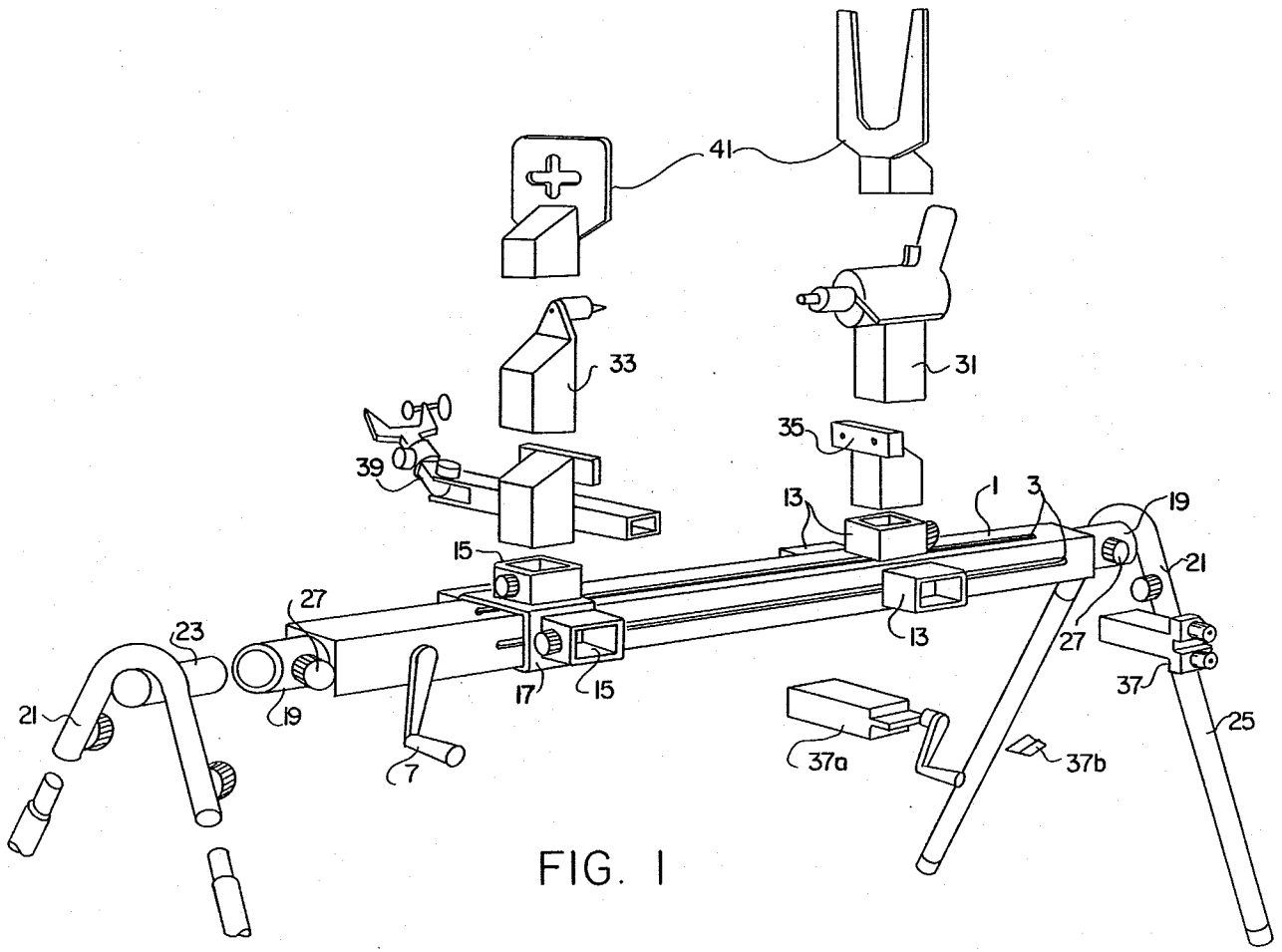

This application is a continuation of application Ser. No. 801,391 filed Nov. 25, 1985 now abandoned which is a continuation of Ser. No. 560,470 filed Dec. 12, 1983 now abandoned.

The present invention relates to a multi-purpose portable work station, particularly suitable for home use by the home handyman. It can also be used for commercial/industrial use, i.e. on site or maintenance work.

It is frequently necessary to perform operations on wood, metal, or other such materials, where it would be advantageous to have some form of structure for holding either the materials to be operated on or for the tools for operating on them, or both. Unfortunately, no such apparatus is available which is particularly suited to a variety of uses. Most proprietory pieces of equipment are suited to performing only a specific function, be it wood working lathe, drill stand, clamp, work bench, or the like.

It is an object of the present invention to provide multi-purpose work station which permits automatic alignment of a headstock and tailstock, but which also permits them to be stationed in angular positions inclined to the vertical.

According to the present invention, there is provided a multi-purpose portable work station comprising a stand, a holow spine of substantially rectangular cross-section, the spine being mounted on the stand so that the angular position of the spine can be adjusted by rotating the spine about its longitudinal axis, the spine being releasably stationed in any angular position to which it is adjusted, a leadscrew mounted in and extending longitudinally of the spine, at least one nut threadably received on the leadscrew, at least two socket devices mounted to slide on the spine but fast against angular displacement thereon; each socket device including at least one socket directed outwardly with respect to the spine and adapted to detachably receive a complementarily shaped member of an attachment; each socket being of a cross-section to prevent rotation therein of a said member and structure on each socket for readily but releasably securing a member therein in order to prevent the attachment falling from the socket when the spine is stationed in an angular position to leave the attachment of the member otherwise than upright.

Preferably, the central hollow spine is square or rectangular in cross-section, and has a longitudinally extending slot in three of the sides whereby three headstock sockets can be secured to the nut for securing headstocks thereto. Preferably three tailstock sockets are provided on a single saddle or support member which comprises a hollow section slidably received on the central hollow spine. Clamping means are provided for securing the tailstock in a desired position. Mounting means are provided for the central spine and this preferably comprises two frame end members or stands, conveniently made from tubular or round spigot attached thereto which is adapted for co-operating engagement with a tubular sleeve carried by the spine. Each end of the spine is provided with a tubular sleeve, so that, when a stand is fitted at each end the spine may be mounted horizontally. The stands can be provided with leg extensions to facilitate floor or bench mounting. The spigot and the tubular sleeve permit the spine to be rotated relative to the stands so that any one of the three accessory location points can be uppermost. The spine can be mounted vertically by placing the stand on a horizontal surface. The spine can also be used without the stand/leg extensions as particular work-stations may require.

The headstock and tailstock sockets can be arranged to accept a wide variety of fittings as will be described further hereinafter. The number of uses can be increased beyond those specified as further accessory types are developed.

Figure 2:
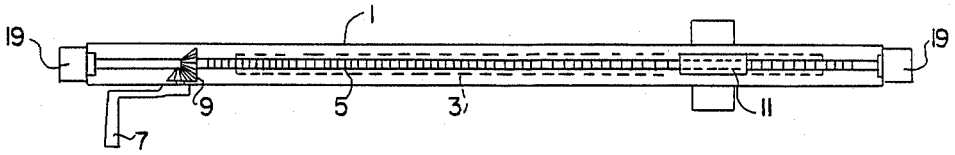
Figure 3:
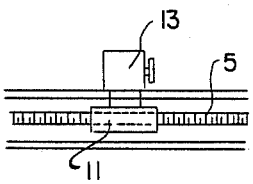
Figure 4:
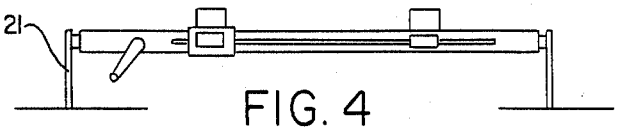
Figure 5:
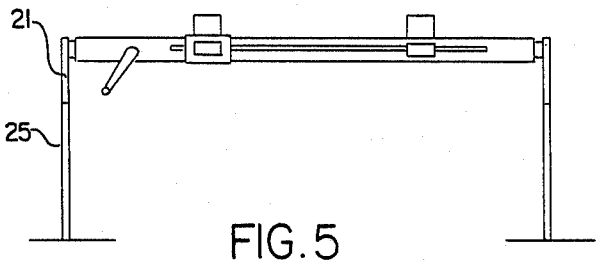
Figure 13:
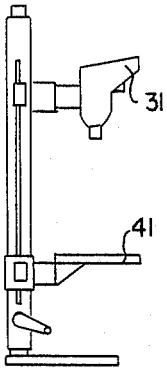
Figure 6:
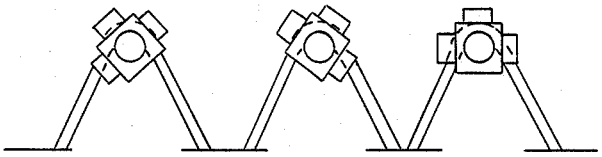
Figure 12:
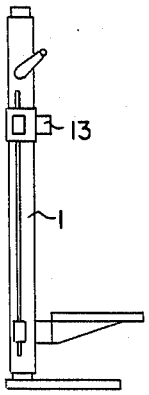
Figure 14:
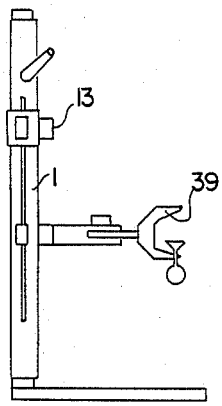
Figure 15:
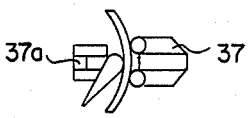
Figure 16:
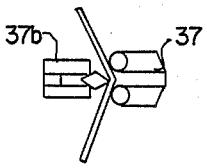

The present invention will now be described further, by way of example, with reference to the accompanying drawings, in which:

FIG. 1 is a partially exploded perspective view of one embodiment of the invention, FIG. 2 is a diagrammatic sectional view of the central spine, FIG. 3 is a diagrammatic view showing the connection of the headstock, FIGS. 4 and 5 show the central spine horizontally mounted with short and long legs respectively, FIG. 6 is an end view of the work station showing some different angular positions of the spine, FIGS. 7 to 11 illustrate some of the accessories which can be used with the work station, FIGS. 12 to 14 illustrate the work station in the vertical position with some of the accessories, and FIGS. 15 and 16 show pipe and strip metal bending and rolling accessories.

Referring more particularly to the drawings, there is shown a multi-purpose portable work station. The work station comprises a central spine 1 which, as illustrated, has a generally rectangular cross-section and is hollow. A longitudinally extending slot 3 is formed in three of the sides of the central spine. A longitudinally extending leadscrew 5 (see FIGS. 2 and 3) is disposed within the hollow spine and is journalled for rotation therein. The leadscrew 5 is rotated by revolving a handle 7 which drives the leadscrew by way of bevel gears 9. The gearing may be adjusted by changing the gears 9. Two alternative gear ratios may be mounted in line on the central rotatable leadscrew. The winding handle could be moved from one driving shaft to the other according to the ratio required.

A threaded nut 11 is received on the leadscrew and is slidable within the hollow spine. Rotation of the nut 11 may be prevented by arranging for the nut 11 to contact the sides of the hollow spine. The threaded nut member carries at least one headstock socket 13, and preferably three, as shown in the described embodiment. The mounting for each headstock socket 13 passes through a respective one of the slots 3 and the mounting of the three headstocks in this way can serve to prevent rotation of the nut member 11. Rotation of the handle 7 causes the headstock socket(s) to move in the axial direction of the spine.

The spine 1 also carries one or more tailstocks 15, three in the described embodiment, and these are received on a hollow tubular member or saddle 17 which is slidably guided on the central spine 1. Clamping means ((not illustrated) may be) comprising a tapped bore 17*a* in saddle 17 and a thumbscrew 18 engaged in said tapped bore 17*a* are provided for securing the saddle 17 and hence the tailstock socket(s) 15 in a desired axial position relative to said spine.

Each end of the spine 1 is provided with a tubular mounting 19 which is adapted for co-operating engagement with a complementarily shaped spigot 23 of a mounting stand 21. Two mounting stands 21 are shown in FIG. 1 and these are conveniently fabricated from tubular steel or the like material, and have two legs formed by a U-shaped member, the legs of which are preferably splayed outwardly. The spigot 23 is secured to the legs so that its axis is perpendicular to the plane of the two legs. The spine 1 may be mounted horizontally by utilizing both stands 21 as a support, or vertically by utilising just one stand and upending the spine, so that the plane of the legs is horizontal and leg extensions 25 are provided which slot into respective legs of the stands so that the spine is at a convenient height when supported on the floor (see FIGS. 4 and 5).

The tubular sleeve 19 and spigot 23 enable the spine to be rotated relative to the mounting stand or stands. Thus any of the three pairs of headstocks/tailstocks an be positioned as desired (see FIG. 6). Clamping means 27 is provided for securing the spine 1 in the desired angular position.

The headstock and tailstock sockets 13,15 are constructed in the form of open ended rectangular boxes. This form of construction enables a number of accessories to be fitted to the headstocks or tailstocks by means of complementarily shaped mounting blocks.

The accessories include: power drill holder 31; tailstock centre 33; vice attachments 35; strip metal and pipe bending and rolling attachments 37; universal clamp and tool holder attachment 39; and various support brackets 41.

Figure 7:
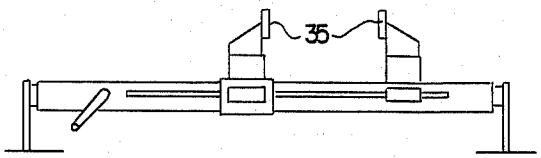
Figure 8:
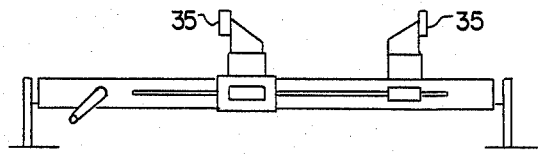
Figure 9:
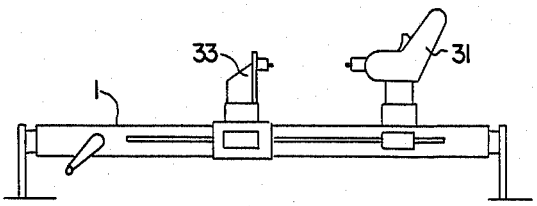
Figure 10:
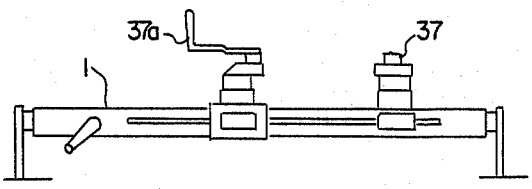
Figure 11:
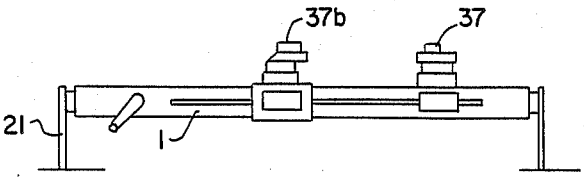

FIGS. 7 and 8 show the work station adapted for use as a vice with clamping action and "push-apart" action respectively. FIG. 9 shows a lathe set-up. FIGS. 10 and 15 show pipe bending arrangements, whilst FIGS. 11 and 16 show strip metal bending attachment.

FIG. 13 shows the work station set up as a drill stand and FIGS. 12 and 14 show general views of a vertical arrangement for lifting and the like.

The spine is preferably about 1m long, although it can be manfactured in various sizes and strengths according to its intended market section, i.e. D.I.Y. or industrial.

I claim:

1. A multi-purpose portable work station comprising:

(a) stand means including spine having two end regions, and spine receiving means located at each end region of the spine, (b) a leadscrew, (c) an elongate hollow spine of substantially rectangular exterior cross section containing said leadscrew therein including:

(1) two elongate sidewalls with an elongate top wall connecting said elongate side walls, at least one of said elongate side walls and said top wall defining an elongate aperture individual thereto, said elongate aperture extending in the axial direction of the spine, (2) means for rotatably supporting said leadscrew within said spine with the axis of said leadscrew extending in the axial direction of the spine, (3) means presented by the end regions of said spine cooperating with and rotatable in the said spine receiving means presented by the stand to allow the said spine to be angularly displaced relative to the stand about an axis generally parallel to the axial direction of the spine, said spine being angularly adjustable relative to said stand through 360 degrees about said axis generally parallel to the axial direction of the spine, (d) means for releasably locking said spine to said stand in any desired angular position of said spine relative to said stand, (e) a nut longitudinally slidable within said spine and in threaded engagement with said leadscrew, said nut including a part which extends into the said longitudinal aperture and said first socket means being rigidly attached to said part, (f) a first socket means externally of said spine, rigidly attached to said nut through said elongate aperture to be displaceable with said nut in axial direction on the spine, said first socket means presenting at least one attachment supporting socket provided with a first clamping means adapted to retain an attachment within said socket and directed outwardly with respect to the spine, (g) a second socket means including a saddle defiing a rectangular aperture through which the spine slideably but nonrotatably extends, said socket means further including at least one attachment-supporting socket provided with a second clamping means adapted to retain an attachment within said socket and extending outwardly with respect to the spine, and (h) means for releasably securing said second socket means in any desired location along said spine.

2. A work station according to claim 1, in which at least one of said socket means comprises a saddle of short tubular construction whose interior closely matches the exterior of the spine, said first and second clamping means each comprising a thumbscrew which can be tightened against an attachment element inserted into said socket.

3. A work station according to claim 2 in which each socket means has at least two sockets which are at right angles to one another and to the longitudinal direction of the spine.

4. A work station according to claim 3, in combination with a headstock attachment adapted to mount a conventional electric drill, and another attachment is in the form of a tailstock attachment , said headstock attachment including an attachment element secured in one socket of one of said socket means and said tailstock attachment including an attachment element secured in one socket of the other said socket means.

5. A work station according to claim 4 in combination with clamping jaws provided as attachments on respective sockets of said two socket means and which clamping jaws can be moved towards or away from one another by rotation of the said leadscrew.

* * * * *